US005406309A

United States Patent [19]

Alelyunas

[11] Patent Number: 5,406,309

[45] Date of Patent: Apr. 11, 1995

[54] VIDEO SIMULATION OF CRT RESPONSE

[75] Inventor: Carl Alelyunas, Beaverton, Oreg.

[73] Assignee: Magni Systems, Inc., Beaverton, Oreg.

[21] Appl. No.: 24,855

[22] Filed: Feb. 26, 1993

Related U.S. Application Data

[63] Continuation of Ser. No. 679,613, Apr. 3, 1991, abandoned.

[51] Int. Cl.[6] ..... G09G 3/00

[52] U.S. Cl. ..... 345/134; 345/147; 345/185

[58] Field of Search ..... 340/793, 767, 722, 799, 340/744; 324/121 R; 364/487; 345/134, 133, 135, 147, 148, 149, 189, 190, 185

[56] References Cited

U.S. PATENT DOCUMENTS

| | | | |
|---|---|---|---|
| 4,223,353 | 9/1980 | Keller et al. | 340/793 |
| 4,504,827 | 3/1985 | Hansen et al. | 340/793 |
| 4,829,293 | 5/1989 | Schlater | 340/722 |
| 4,940,931 | 7/1990 | Katayama et al. | 340/793 |

FOREIGN PATENT DOCUMENTS 2183420 10/1989 United Kingdom .

OTHER PUBLICATIONS

Tektronix VM 700 Video Measurement Set Brochure, 1988–1989 Television Products.

*Primary Examiner*—Ulysses Weldon
*Assistant Examiner*—Xiao M. Wu
*Attorney, Agent, or Firm*—Heller, Ehrman, White & McAuliffe

[57] ABSTRACT

A display memory and controller for displaying waveforms and vectors on raster-scanned conventional video monitors so that the display appears the same as oscilloscope or monitor displays. The brightness of any spot is set by the number of times that an input signal is at the same position on repetitive equivalent sweeps. As the signal passes a time and voltage point, the memory is read to determine the brightness level from before, and a new level is written in to approximate the intensity function of CRT phosphor. As the memory is displayed, the values are decreased to approximate the decay of a CRT phosphor. A memory controller allows the signal to be directly input to memory for later processing for fault determination.

12 Claims, 4 Drawing Sheets

VIDEO SIMULATION OF CRT RESPONSE

This is a continuation of application Ser. No. 07/679,613, filed Apr. 3, 1991, now abandoned.

BACKGROUND OF THE INVENTION

The present invention relates to a video waveform monitor and vectorscope implemented in semiconductor memory using gray scale (digital levels) to simulate the time-domain response of cathode ray tube phosphor.

Video waveform monitors in the prior art usually have an electrostatic-deflection cathode ray tube so that the waveform will be easily visible. The brightness of the image of these CRT's is proportional to the number of times the waveform passes through a single point as the beam is swept across the screen. These specialized CRT's are bulky and expensive. The user also must be in close proximity of the video waveform monitor.

Other prior art devices involve the use of just one intensity level for signal display on a raster scanned monitor, and does not have the resolution needed for waveform monitoring nor the appearance of a standard waveform monitor.

It would therefore be very desirable to provide an improved video waveform monitor which simulates electronically an electrostatic-deflection CRT display on a conventional video picture monitor.

SUMMARY OF THE INVENTION

It is an object of the present invention is to provide an improved video waveform monitor and vectorscope display.

It is another object of the present invention to provide an improved video waveform monitor and vectorscope display wherein the display is itself encoded into a video signal for viewing on a standard video picture monitor.

The displayed video closely simulates the phosphor response of a dedicated cathode ray tube. Once the display is converted to video, it may be routed to other monitors. The simulation is accomplished through the use of display memory whose contents at a given location are either increased or decreased depending on the time and voltage conditions present at the signal input. In order to provide more flexibility of display, a microprocessor has access to the display memory, and a section of the memory is reserved for direct digitization of the input signal and subsequent microprocessor operations.

Other objects, features and advantages of the present invention will become apparent from the following detailed description when taken in conjunction with the accompanying drawings.

BRIEF DESCRIPTION OF THE DRAWINGS

The accompanying drawings which are incorporated in and form a part of this specification illustrate an embodiment of the invention, and together with the description, serve to explain the principles of the invention.

DETAILED DESCRIPTION OF THE INVENTION

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, it is intended to cover alternatives, modifications and equivalents as may be included within the spirit and scope of the invention as defined by the appended claims.

Figure 1:
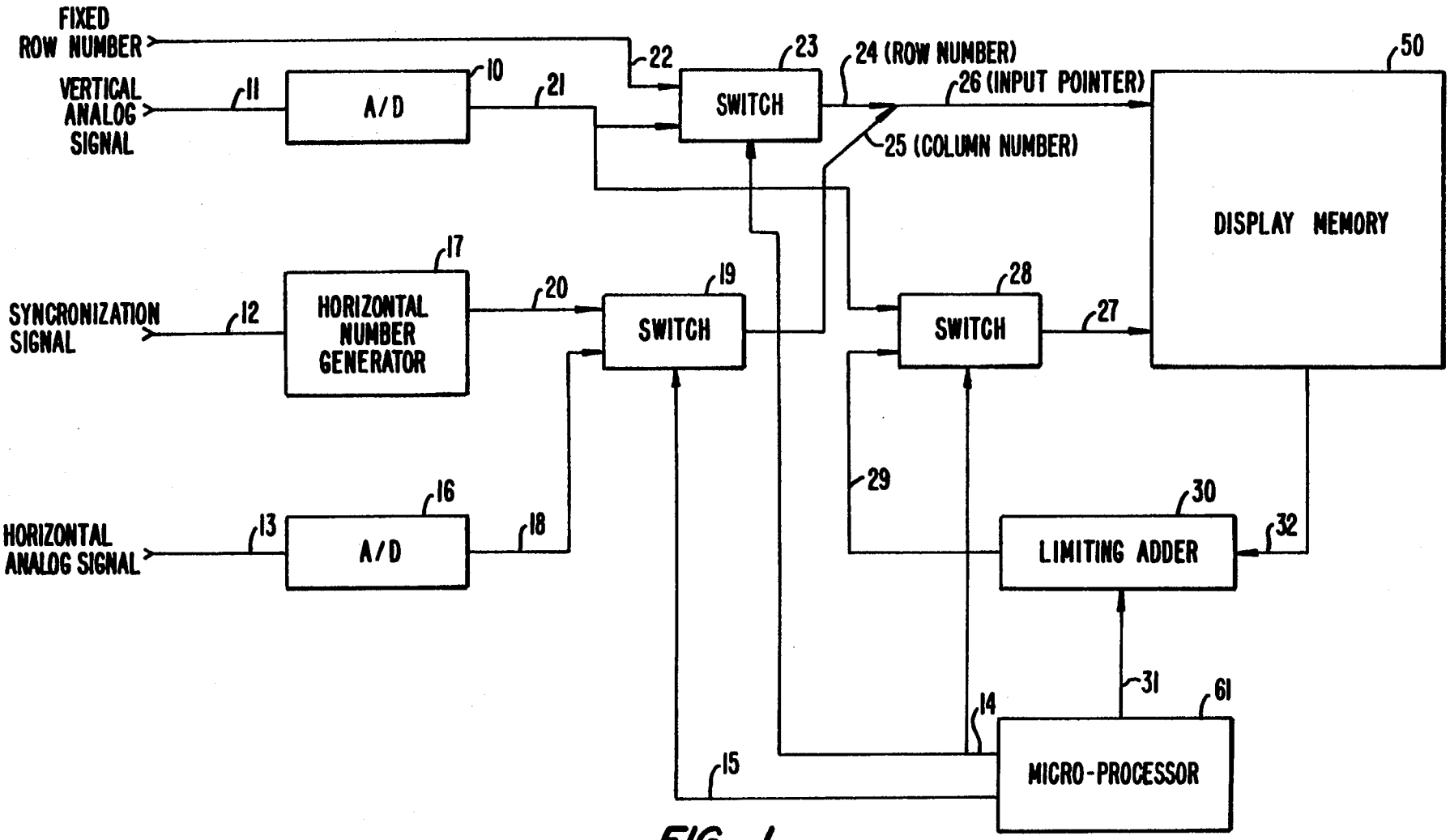
FIG. 1 depicts a block diagram of any Input Signal to Memory Interface, which forms a portion of the present invention.

Referring now to FIG. 1, a block diagram of the Input Signal to Memory Interface according to the present invention is depicted.

The vertical analog signal 11 is the vertical or y-axis input to the display system. This voltage is digitized by the analog-to-digital converter 10. The resultant vertical digital signal 21 connects to switch 23 and switch 28.

Switch 23 selects between the vertical digital signal 21 and the fixed row number 22 under control of the capture signal 14 from the microprocessor 61. The output 24 of the switch 23 is designated as the row number.

Switch 28 selects between the vertical digital signal 21 and limited intensity data 29 under control of the capture signal 14. The output of the switch 28 is designated as the input write data 27 for putting brightness level or signal level into the display memory 50.

The synchronization and clock signal 12 is from synchronization circuits well known to the industry. The horizontal number generator 17 receives the synchronization and clock signal 12, and generates a time-related number 20. Number generator 17 is a counter which is clocked at a rate that is related to the vertical input signal 11, generating time related addresses for the display memory 50.

The horizontal analog signal 13 is the horizontal or x-axis input to the display system for the x-y mode. This analog voltage is converted to a horizontal digital signal 18 through the analog-to-digital converter (A/D) 16.

The switch 19 selects between the time-related number 20 and the horizontal digital signal 18 under control of the vector signal 15 from the microprocessor 61 to allow x-y mode for the vector display. The output of the switch 19 is designated column number 25.

The row number 24 and the column number 25 comprise the input address pointer 26 to the display memory 50.

The limiting adder 30 mathematically adds the input read data 32 to the intensity number 31, and if the sum is greater than the maximum number, the result becomes the maximum number. The result is designated the limited intensity data 29.

The system control microprocessor 61 generates the intensity number 31 allowing the intensity of the display to be changed.

The block diagram of FIG. 1 is analogous to the input and CRT of an oscilloscope. The memory 50 is addressed sequentially in the x-axis to simulate the scope sweep. The voltage or y-axis input 11 sets the video line address, or y-axis address pointer 26. The memory depth is set by the brightness range required. An eight bit memory gives two hundred fifty-six levels or a six bit memory gives sixty-four levels of brightness. The previous brightness level 32 is read from the memory 50 at x and y equivalent point in memory. An increased brightness is added back into the memory 50 through the input write data signal 27.

Figure 2:
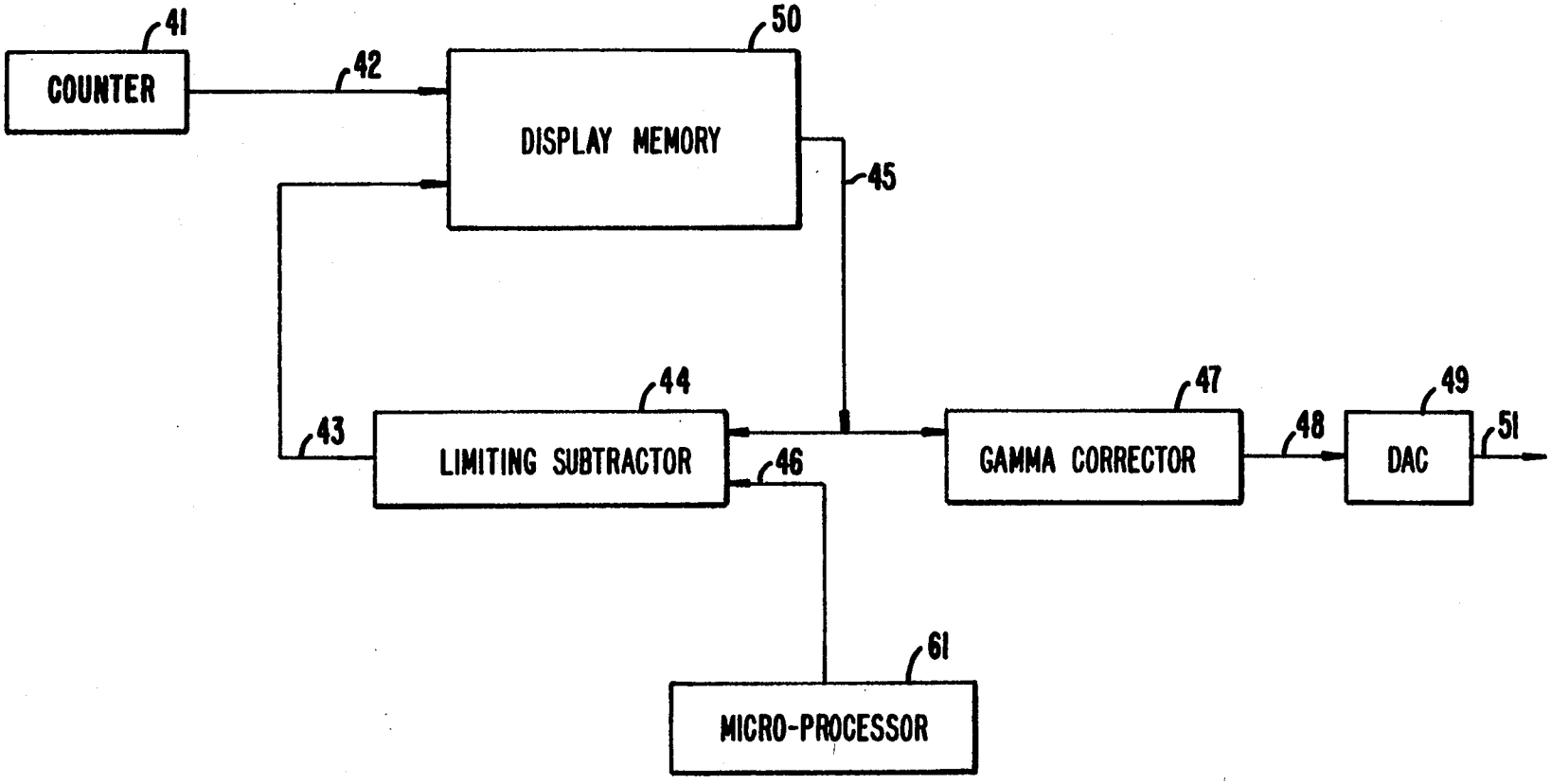
FIG. 2 depicts a block diagram of a Memory to Output Signal Interface which forms a portion of the present invention.

Referring now to FIG. 2, a block diagram of the Output Signal to Memory Interface according to the present invention is depicted. This section controls the display output and simulated intensity decay of a normal oscilloscope CRT.

Counter 41 generates a sequential output pointer 42 into the display memory 50. The decay number 46 generated by the microprocessor 61 is subtracted from the output read data 45 by the limiting subtractor 44. The limiting subtractor 44 generates the output write data 43 by choosing the greater of zero and the output read data 45 minus the decay number 46.

The output read data 45 is converted to the gamma-corrected data 48 by the gamma corrector 47. The gamma corrector 47 may be implemented as a look-up table that is loaded by the microprocessor 61. The gamma-corrected data 48 is converted to the analog video output signal 51 by the digital to analog converter (DAC) 49. Blocks 47 and 49 are combined into a graphics RAMDAC part in the present embodiment of the invention. The gamma corrector may also be implemented by controlling the input brightness levels to memory at 27 by adder 30.

Figure 3:
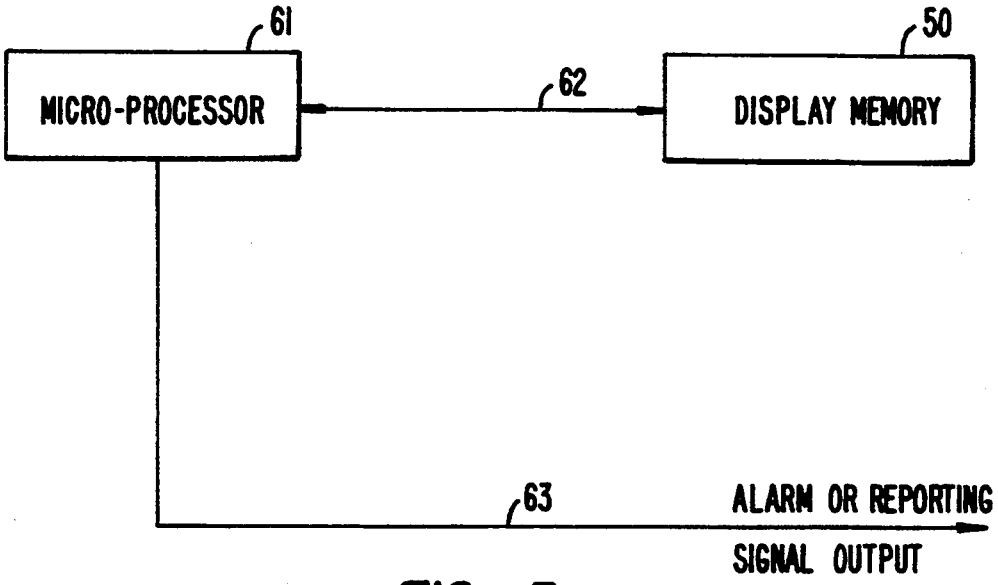
FIG. 3 depicts a block diagram of a Microprocessor to Memory Interface which forms a portion of the present invention.

Referring now to FIG. 3, a block diagram of the Microprocessor to Memory Interface according to the present invention is depicted.

The microprocessor 61 interfaces to the display memory 50 through the microprocessor bus 62, and may read or write any location in the display memory 50. Depending on the contents of the display memory 50 the microprocessor 61 may assert the alarm or reporting signal output 63.

Figure 4:
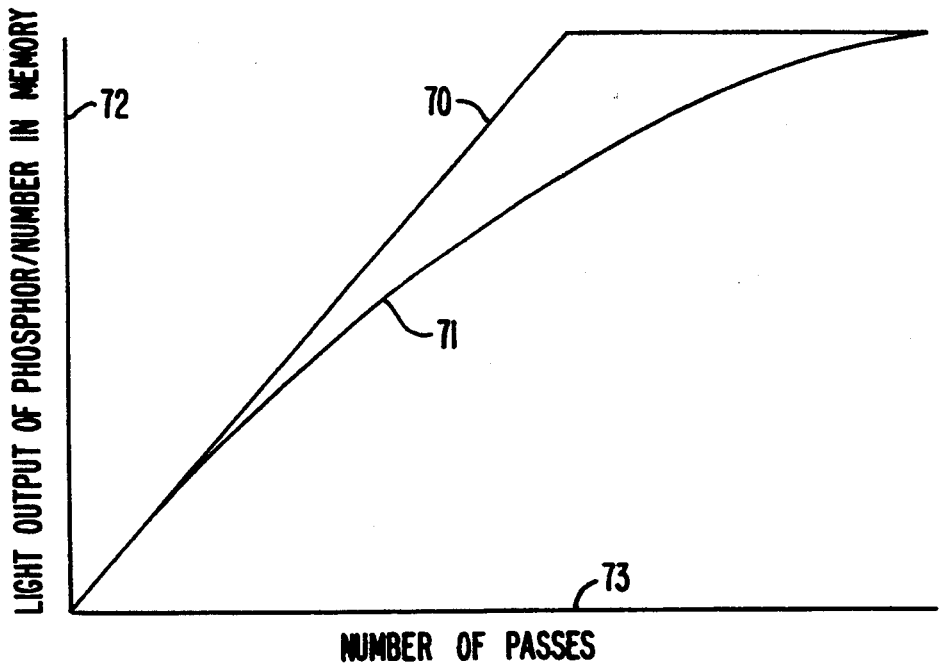
FIG. 4 depicts graphically the typical contents of a single display memory point with multiple passes of a voltage-time point, and the typical electron-beam excited phosphor intensity response with multiple passes of the electron beam by a single point.

Referring now to FIG. 4, a Typical Intensity Response is depicted graphically. The vertical axis 72 is relative units of light intensity output of a typical phosphor and the number contained in a single memory location. The horizontal axis 73 represents multiple passes of an electron beam at a single point on a CRT screen, and multiple passes of a voltage-time point in memory. Curve 70 shows the resultant equivalent number in memory (simulation), and curve 71 shows the response of a phosphor.

Figure 5:
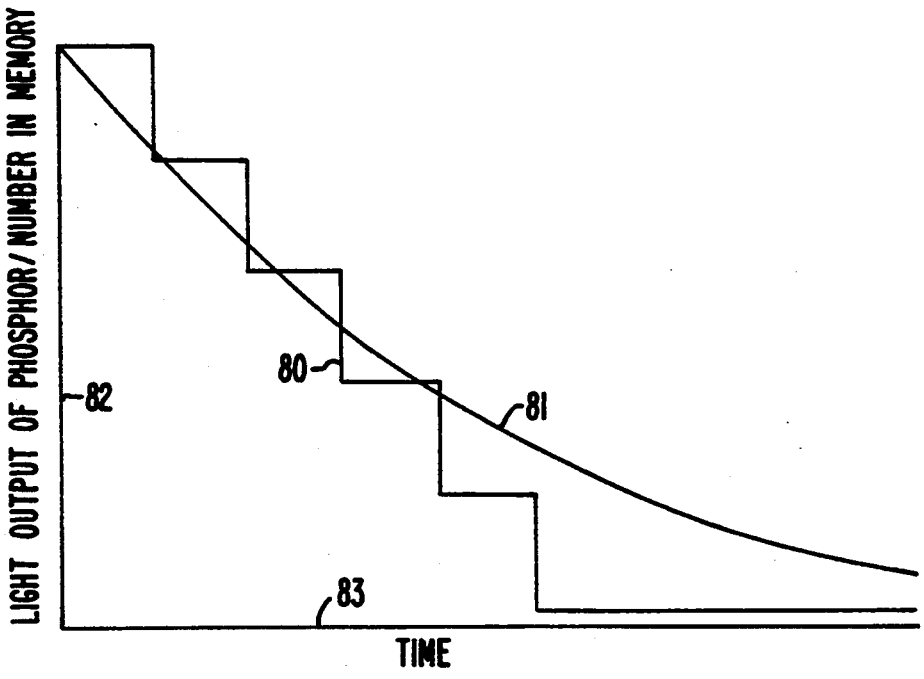
FIG. 5 depicts graphically the typical contents of a single display memory point with time, and a typical phosphor light intensity decay function with time.

Referring now to FIG. 5, a Typical Decay response is depicted graphically. The vertical axis 82 is relative units of light intensity output of a typical phosphor and the number contained in a single memory location. The horizontal axis 83 represents time. Curve 80 shows the resultant equivalent number in memory (simulation), and curve 81 shows the response of a phosphor.

Principle of Operation

Referring to FIGS. 1–5, access to the display memory 50 is time-shared between the input pointer 26, the output pointer 42, and the microprocessor bus 62.

During the time the input pointer 26 is active, a row number 24 and a column number 25 point to a specific location in the display memory 50, depending on the time-voltage conditions present at the vertical analog signal 11. The contents of that memory location appear as the input read data signal 32. This information is added to the intensity number 31 and limited, and appears at the input write data signal 27. The input write data 27 is then written into the same memory location, still pointed to by the input pointer 42. In this fashion, the number in the memory location simulates closely the light output response of a spot on a CRT screen which has been excited by multiple passes of an electron beam. These responses are shown graphically in FIG. 4.

During the time the output pointer 42 is active, columns and rows of locations in the display memory 50 are accessed sequentially. At each location in display memory 50, the decay number 46 is subtracted from the output read data 45, and the greater of that result and zero is applied as output write data 43 to the same location in display memory 50. In this fashion the number in the memory location simulates closely the light output response of a given spot of phosphor as it decays with time. These responses are shown in FIG. 5.

The output read data 45 is applied to the gamma corrector 47, whose non-linear response to applied data further approximates the phosphor responses. The digital-to-analog converter 49 converts the gamma-corrected data 48, which is organized sequentially in column and row, into video output 51. This output may be routed through conventional video handling equipment, and displayed on a conventional video picture monitor.

During the time the microprocessor bus interface 62 is active, the microprocessor 61 has access to all information stored in the display memory 50.

An alternative mode of operation is achieved when the vector signal 15 is asserted. Then the column number 25 is the digital representation of the horizontal analog signal 13. The display memory 50 is accessed in the same fashion as before. This displays a horizontal voltage versus vertical voltage intensity pattern, commonly called a vector display.

Another mode of operation is achieved when the capture signal 14 is asserted. Then the digital representation of the vertical analog signal 11 is written directly to the display memory 50, sequentially with time, to a single reserved row determined by the fixed row number 22. This is so that the microprocessor 61 may perform operations on the digital representation of the incoming vertical analog signal 11 to determine alarm conditions, at which time the microprocessor 61 will assert the alarm or reporting signal output 63. These alarm conditions include, but are not limited to:

A. Subcarrier to horizontal phase error. The digital representation in the reserved row includes both subcarrier phase information and horizontal information, and the timing difference may be extracted mathematically.

B. Multiple channel timing error. Two subsequent signals may be captured in the reserved row, and their relative timing may be determined.

C. Level or offset error. A captured signal may be analyzed for level or offset, and an error indicated for signals outside a predetermined range.

The present invention provides a virtual waveform monitor and vectorscope implemented in memory with a video output for display on a standard picture monitor. In order to closely simulate the response of a CRT phosphor, an input waveform is digitized, and that digital data is used as a pointer into memory in the vertical direction. Time information comprises the horizontal pointer. The memory location pointed to is read, a constant added and re-written to simulate the incremental intensity due to the passage of an electron beam in a CRT. As the memory is read for display, a constant is subtracted to simulate the time domain decay of the CRT phosphor. A section of memory is received from direct digitization of the incoming waveform. This allows a microprocessor to mathematically extract operational information from the incoming waveform.

The foregoing description of the preferred embodiment of the present invention has been presented for purposes of illustration and description. It is not intended to be exhaustive or to limit the invention to the precise form disclosed, and many modifications and variations are possible in the light of the above teaching. The preferred embodiment was chosen and described in order to best explain the principles of the invention and its practical applications to thereby enable others skilled in the art to best utilize the invention and various embodiments and with various modifications as are suited to the particular use contemplated. It is intended that the scope of the present invention be defined only by the claims appended hereto.

What is claimed is:

1. An apparatus for simulating the time domain brightness response of an electrostatic-deflection cathode ray tube, comprising:

a video display monitor;

means for generating a digitized waveform from an analog input waveform;

display memory means, coupled to said means for generating, having a plurality of memory locations for storing information about said digitized waveform;

each of said memory locations corresponding to a point on said video display monitor;

said information including a predetermined, quantized range of brightness levels;

a microprocessor, including alarm testing means for performing operations on the contents of said display memory means to detect an alarm condition, and for generating an alarm when an alarm condition is detected;

said microprocessor further including means for arbitrating access to said display memory means;

first means for controlling the brightness level stored in a predetermined memory location, including:

means for reading said brightness level from said predetermined memory location, and for increasing the stored brightness level by a predetermined amount, such that the increased brightness level simulates the response of a cathode ray tube phosphor to an additional pass of an electron beam; and means for writing the increased brightness level into said predetermined memory location;

second means for controlling the brightness level stored in each memory location, including:

means for sequentially reading the brightness level from each memory location, and for decreasing the stored brightness level by a predetermined amount such that the decreased brightness level simulates the time domain response of a cathode ray tube phosphor; and means for writing the decreased brightness level into the same memory location.

2. The apparatus of claim 1 wherein said alarm condition is subcarrier to horizontal phase error.

3. The apparatus of claim 1 wherein said alarm condition is multiple channel timing error.

4. The apparatus of claim 1 wherein said alarm condition is level error.

5. The apparatus of claim 1 wherein said alarm condition is offset error.

6. The apparatus of claim 1, further including means, coupled said video monitor, for sequentially reading said display memory means so as to display said information on said video monitor, and for decreasing the displayed brightness level to simulate the nonlinear gamma response of a cathode ray tube phosphor.

7. The apparatus of claim 1 wherein said means for increasing the stored brightness level is controlled by said microprocessor.

8. The apparatus of claim 1 wherein said means for decreasing the stored brightness level is controlled by said microprocessor.

9. The apparatus of claim 1 further including second means, coupled to said display memory means, for generating a second digitized waveform from a second analog input waveform, and wherein said memory locations also store information about said second digitized waveform, so that a vector display may be produced on said video display monitor.

10. The apparatus of claim 1 wherein each of said plurality of memory locations has a memory depth of between 6 and 8 bits.

11. A video signal monitor comprising:

video display means for displaying waveform and vector information;

means for generating a digitized waveform from an analog input waveform;

display memory means, coupled to said means for generating, having a plurality of memory locations for storing information about said digitized waveform;

each of said memory locations corresponding to a point on said video display means;

a microprocessor for arbitrating access to said display memory means;

first means for controlling the brightness level stored in a predetermined memory location, including:

means for reading said brightness level from said predetermined memory location, and for increasing the stored brightness level by a predetermined amount, such that the increased brightness level simulates the number of times a cathode ray tube phosphor is struck by an electron beam; and means for writing the increased brightness level into said predetermined memory location;

second means for controlling the brightness level stored in each memory location, including:

means for sequentially reading the brightness level from each memory location and for decreasing the stored brightness level by a predetermined amount such that the decrease in brightness level simulates the time domain response of a cathode ray tube phosphor; and means for writing the decreased brightness level into the same memory location;

means for controlling the brightness level displayed on said video display means, including:

means for sequentially reading the brightness level from each memory location into a lookup table, said lookup table used to generate a digital output signal which simulates the non-linear gamma response of a cathode ray tube phosphor; and a digital to analog converter, coupled to said digital output signal, for converting said digital output signal to an analog output signal capable of being displayed on said video display means, wherein said digitized waveform is stored in said display memory means as a direct representation of said analog input waveform and wherein said microprocessor includes alarm testing means for performing operations on the contents of said display memory means to detect an alarm condition, and for generating an alarm when an alarm condition is detected.

12. The video signal monitor of claim 11 wherein said microprocessor includes signal measurement means for performing operations on the contents of said display memory means to measure video signal levels.

* * * * *